US005226293A

United States Patent [19]

Brock

[11] Patent Number: 5,226,293

[45] Date of Patent: Jul. 13, 1993

[54] RETROFIT LOUVER SYSTEM FOR EVAPORATIVE AIR COOLERS

[75] Inventor: James A. Brock, Alexander, Ark.

[73] Assignee: Walton Enterprises II L.P., Bentonville, Ark.

[21] Appl. No.: 899,709

[22] Filed: Jun. 15, 1992

[51] Int. Cl.[5] ..... F28D 5/00

[52] U.S. Cl. ..... 62/304; 261/106

[58] Field of Search ..... 62/304, 309, 316; 261/DIG. 3, DIG. 41, 103, 106; 454/201, 277, 283

[56] References Cited

U.S. PATENT DOCUMENTS 4,419,300 12/1983 Vanness et al. ..... 261/DIG. 3

4,833,896 5/1989 Carlson ..... 62/304

*Primary Examiner*—John M. Sollecito

*Attorney, Agent, or Firm*—Stephen D. Carver

[57] ABSTRACT

A modular, reversible louver and offset evaporative media housing system for evaporative air coolers primarily comprising a panel having downwardly cast louvers and a body in the shape of a truncated pyramid, contiguous with and sloping away from the louvers. The body defines an internal volume offset from the louvers for confining an evaporative media. The louvers extend between two side and one central louver rails. A shoulder defined in the interior of the body between the louvers and the internal volume offset the louvers from the evaporative media. Ribs are disposed on the interior surfaces of the bottom and sides of the body for setting the evaporative media off from the sides and bottom. An inverted trough disposed on the interior surface of the top mounts a perforated water distribution tube for supplying water. A peripheral flange extends perpendicularly from the body for adaptively securing the system to a new or existing evaporative cooling unit cabinet. A plurality of paired, spaced apart circular bosses are disposed on the interior surfaces of lips extending generally perpendicular to the flange. The circular bosses axially support a plurality of hollow retaining bars that confine the evaporative media within the interior volume. The panels are reversible to reduce the overall volume of a cooling unit for shipping or storage.

14 Claims, 5 Drawing Sheets

RETROFIT LOUVER SYSTEM FOR EVAPORATIVE AIR COOLERS

BACKGROUND OF THE INVENTION

The present invention broadly relates to evaporative cooling systems. More particularly the present invention relates to Retrofit Louver Systems for Evaporative Air Coolers. It is believed best classified in U.S. Class 62, Subclass 304 or Class 261, Subclass 94, 106 or 029.

Evaporative air coolers are well known in the art. Typical evaporative air coolers employ a motorized fan to draw ambient air into the cooler housing. The air passes through a wet absorbent media for cooling. Various types of absorbent media have been employed, including trickle pads, fiber filters, and excelsior mats. When the water evaporates, heat is removed from the air, and the air is thus cooled. As the air temperature decreases, its humidity increases. The evaporative system will not function unless the water supply to the system is maintained.

Evaporative coolers can provide relatively inexpensive air conditioning in warm, dry environments with low relative humidity. They are most efficient when a significant wet bulb depression exists. In the past, evaporative air coolers have been widely employed in arid or even desert regions where they can provide twenty to thirty degrees of cooling relatively inexpensively.

Cooling systems intended to take advantage of the evaporation cooling principle have been in use throughout this country for many years. These units have gained in popularity due to the possibility that chlorofluorocarbon refrigerants employed in compressor cooling systems can be damaging to the environment. Generally, evaporative coolers employ a cabinet which has a wetted media associated with an air intake grate secured to at least one of the unit's exterior sides. Air is pulled through the media to facilitate evaporation. The media is generally contained within a framework or housing. These a trough or other mechanism maintains the moisture content of the media. Modern materials employed for these evaporative media include Aspen based media and CELDek TM manufactured by Munters Inc.

The evaporative media employed by evaporative coolers deteriorates over time. The need to replace this media eventually lead to innovations such as U.S. Pat. No. 4,833,896, issued May 30, 1989, to Rene Carlson. This patent discloses a disposable cooler pad apparatus that is adapted to be retrofitted to preexisting evaporative coolers. The apparatus is intended to be a replacement assembly for the factory provided pad assemblies. These units are disposable and employ Styrofoam for construction of the louvers. Another relevant Prior art patent is Goettl, U.S. Pat. No. 4,672,820, Issued Jun. 16, 1987. It includes a grill structure for distributing the air which spaces apart and retains a pad assembly.

U.S. Pat. Nos. 4,309,365 and 4,419,300, both issued to Van Ness, disclose louver assemblies that can be quick-mounted to the sides of evaporative air coolers. Another Goettl patent, U.S. Pat. No. 4,045,523, shows a cross-section of one such louver assembly.

All the above cited patents disclose housings for cooler pads or other evaporative media that are made of metal, with the exception of Carlson. However, the assembly in Carlson is considered a disposable unit. Therefore, the prior art generally overlooks the desirability of a permanent, resilient, noncorrosive housing for an evaporative media. While the galvanized metallic housings are non-corrosive to a point, bends and breaks are necessary to form complicated corners and reinforcements in these pieces. These breaks result in breaches in the galvanization. The consequence is rust at critical joints.

SUMMARY OF THE INVENTION

An improved reversible offset louver retrofit system for evaporative air coolers is desired to satisfy the long felt need in the industry for a replacement or original equipment louver system to house an evaporative media. The present invention satisfies that need by providing a resilient housing constructed of modern high-strength plastic that is corrosion resistant. Further, my system presents an esthetically pleasing appearance due to the seamless nature imparted to it through the injection process used to manufacture it.

The present system is modular. The primary component is a panel principally composed of a body, louvers, and a peripheral mounting flange. The system is intended to take full advantage of modern evaporative media and their superior cooling capacities as well as their superior longevity. A media embodying these properties is CELDek TM manufactured by Munters Inc. The evaporative media is retained within an interior volume of the body. The media is wetted to provide evaporative cooling when air is passed through it. A polyester pad or other nonabsorbent material isolates the moisture of the evaporative media from the internal components of the air cooler.

The body has the general shape of a truncated pyramid. Therefore, it slopes away from a set of frontal louvers to facilitate drainage. Ribs cast into the body support the evaporative media. A perforated water distribution tube in the top of the body provides water from an outside source to the evaporative media.

The louvers are comprised of two sets of parallel individual louvers. The outer face of an individual louver is lower than the inner face of the louver. This slant aids in retaining moisture within the unit and preventing the entrance of precipitation. The louver area is offset from the media for the same purposes.

A peripheral mounting flange extends outward from the body. This flange is constructed of the same resilient plastic as the body and louvers. Therefore, the flange can be cut and drilled to fit a variety of cabinet configurations or screwed to an existing cabinet.

A lip extends generally perpendicularly from the flange. Round PVC retaining bars extend from the bottom section of this lip to the top section. These bars mate with circular bosses disposed on the bottom and top lips. These retaining bars secure the evaporative media and polyester pad within the interior volume of the body. The evaporative media is replaced by flexing the retaining bars to remove them from the bosses. The evaporative media is replaced. Then the retaining bars are flexed back into place on the bosses. The system can be mounted in reverse on the cooler unit, with the body of the panel disposed within the unit. This configuration reduces shipping and storage volume of units employing the present system as original equipment.

Therefore, a primary object of the present invention is to provide a lightweight modular retrofit evaporative media housing and louver system.

A more specific object of the present invention is to provide a louver system capable of being field adapted for particular application.

A further object of the present invention is to provide a lightweight replacement louver system.

Additionally, an object of the present invention is to provide a corrosion resistant evaporative media housing and louver system.

A peripherally related object is to provide a vibration resistant evaporative media enclosure and louver system for evaporation coolers.

A primary object of the present invention is to provide an easily serviceable enclosure for evaporative media.

A further object of the present invention is to provide an evaporative media housing which will facilitate the retention of moisture within the evaporative media and the cabinet of the unit.

A related object of the present invention is to provide an environmentally sound arrangement to house an evaporative media and to conserve water.

Another object of the present invention is to provide a system which is reversible on units manufactured employing the present invention as original equipment, thereby reducing the volume of the units for shipping and storage.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
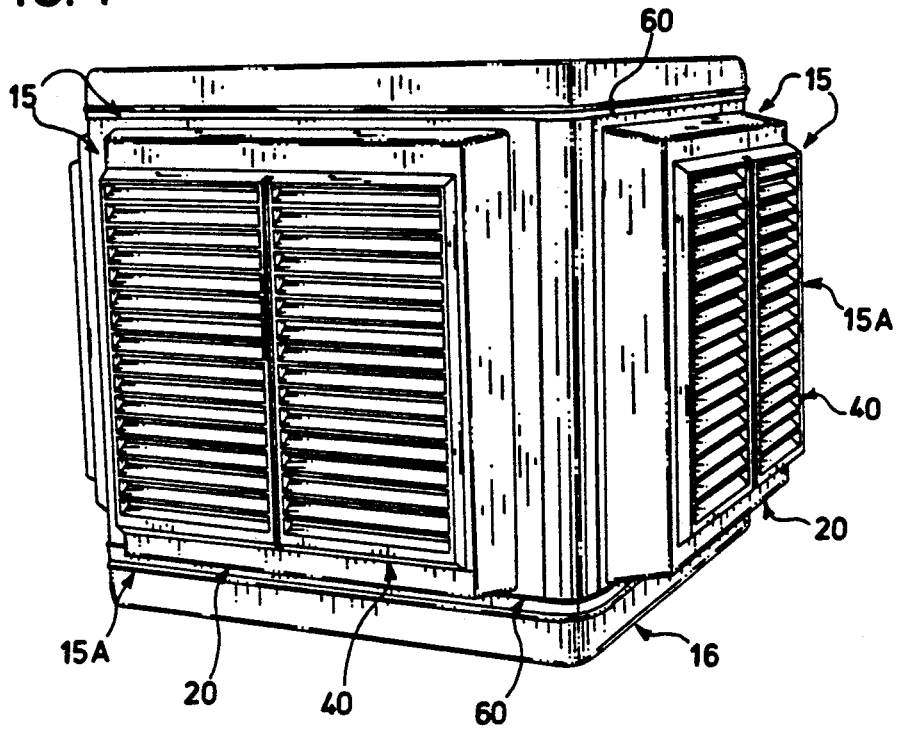
FIG. 1 is a perspective view of a typical evaporative air cooler upon which at least one of my Reversible Offset Louver Retrofit System for Evaporative Air Coolers has been installed.

Turning now to the appended drawings, the best mode of my Retrofit Louver System for Evaporative Air Coolers is broadly designated by the reference numeral 15. The primary component of the below described system 15 is a modular panel 15A, primarily comprised of a body 20, louver assembly 40, and a peripheral mounting flange 60. An evaporative media 99 is retained within an interior volume 20A defined by the body 20. The media 99 is wetted to provide evaporative cooling when air is passed over it. A polyester filter pad 99A or other nonabsorbent material partially isolates the moisture of the evaporative media 99 from the internal components of the air cooler 16.

Figure 4:
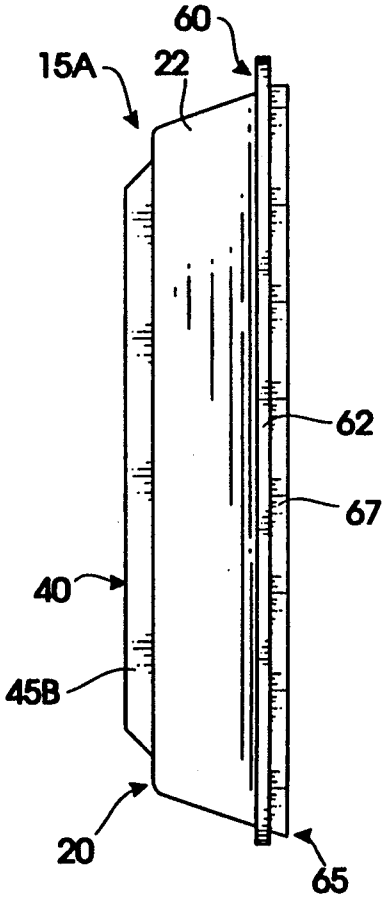
FIG. 4 is a right side elevational view of a typical panel, as seen from a position generally to the right of FIG. 3, the left side comprising a mirror image thereof.
Figure 3:
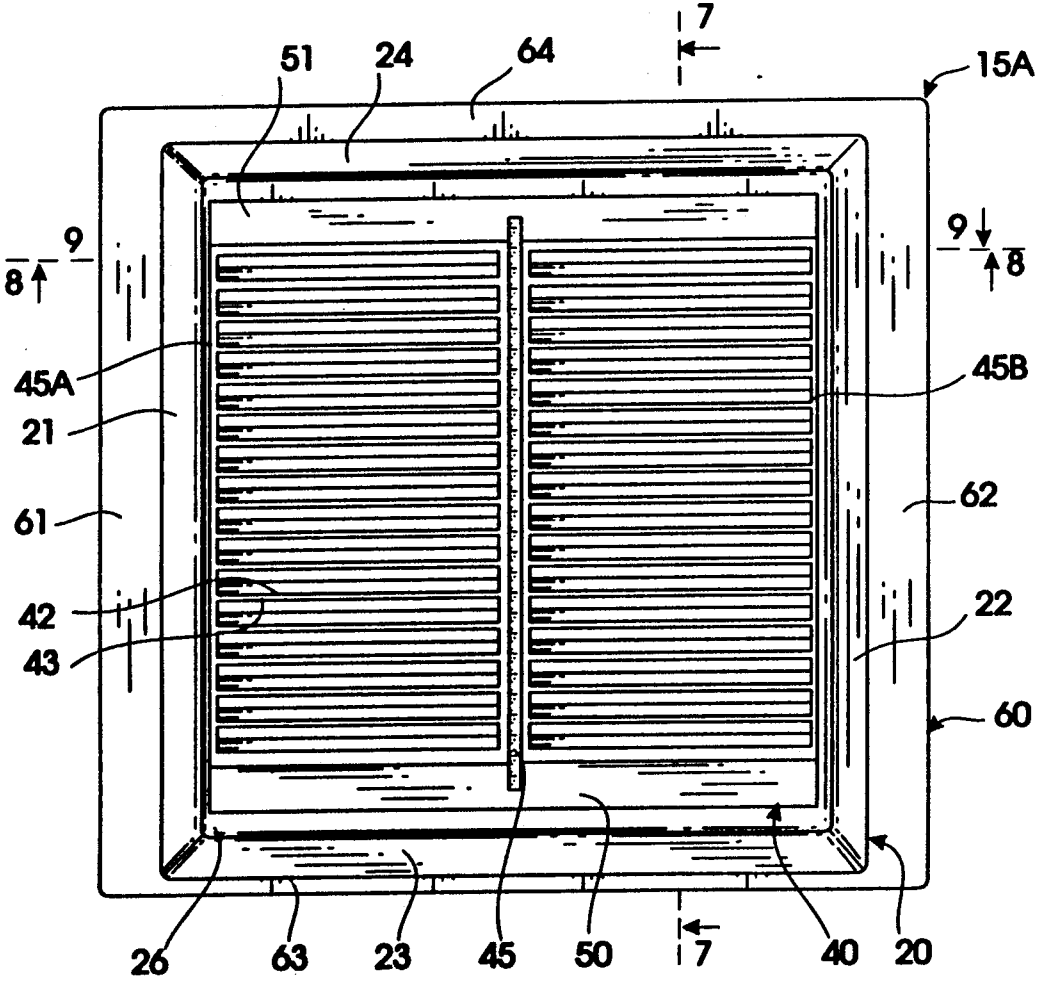
FIG. 3 is a front elevation view of a typical panel.
Figure 5:
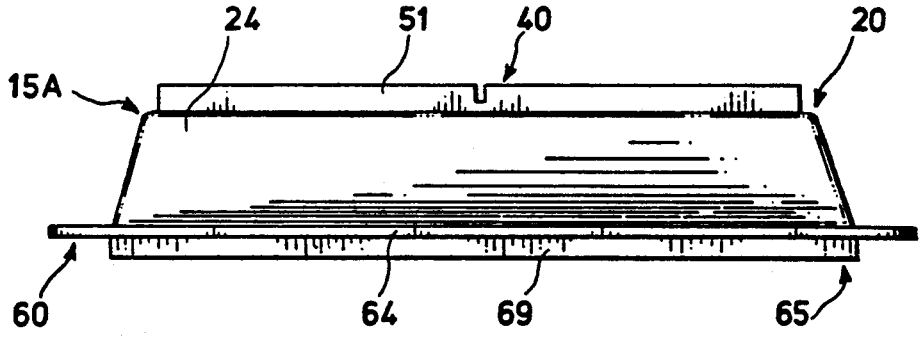
FIG. 5 is a bottom plan view of a typical panel, the top comprising a mirror image.
Figure 6:
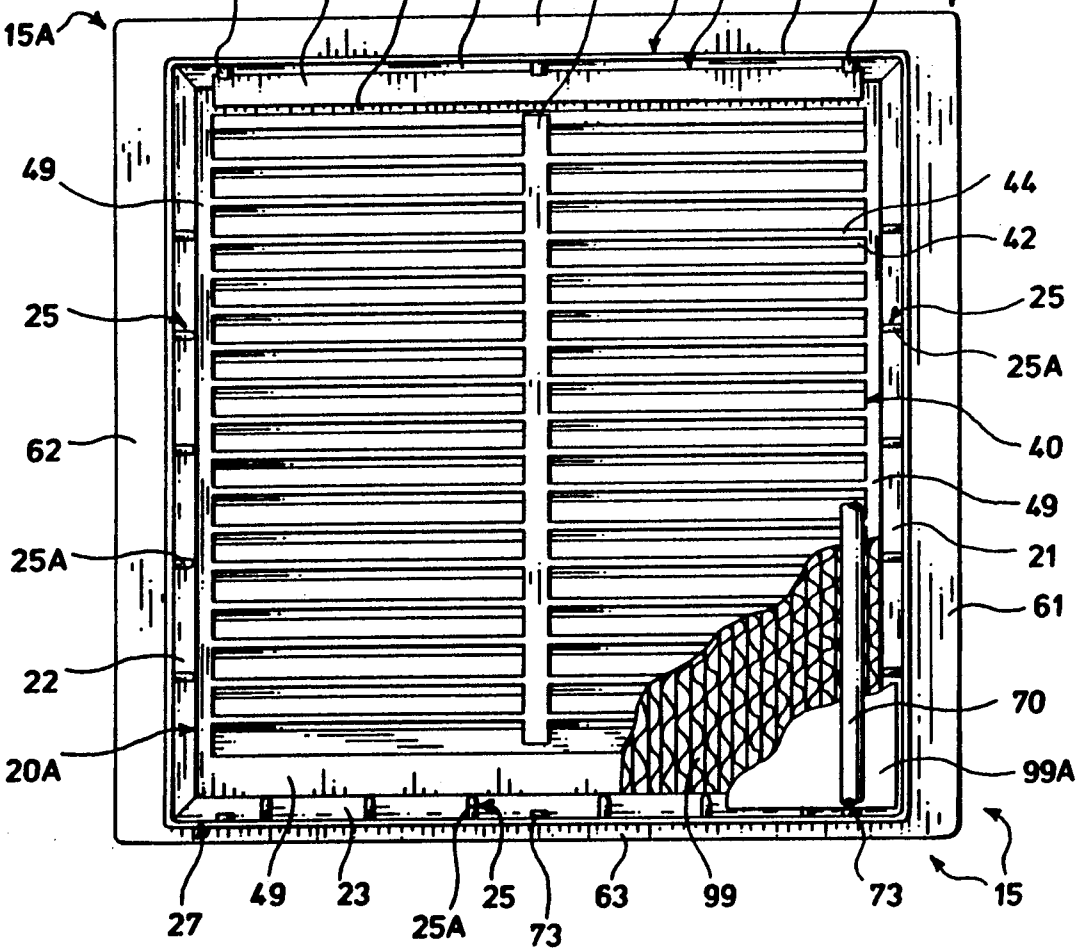
FIG. 6 is a fragmentary rear elevational view of the system, showing the internal volume and details of the panel with break away illustrations of the evaporative media, polyester filter pad and retaining bars.
Figure 8:
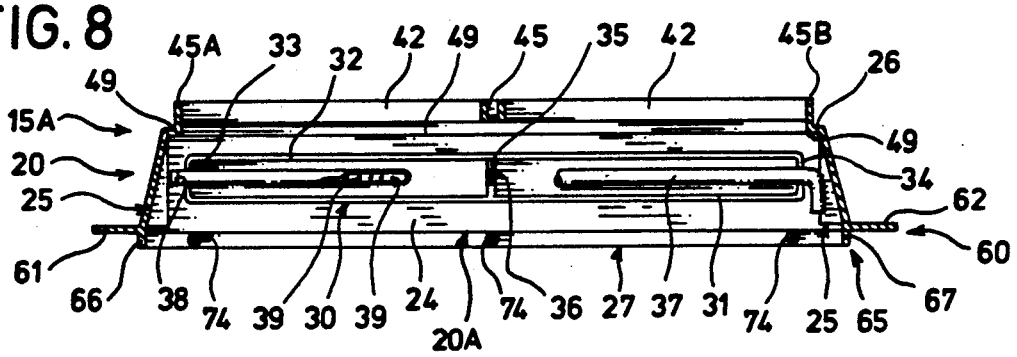
FIG. 8 is a sectional view of the assembled panel system taken generally along line 8—8 of FIG. 3, illustrating the trough and the water distribution tube.
Figure 9:
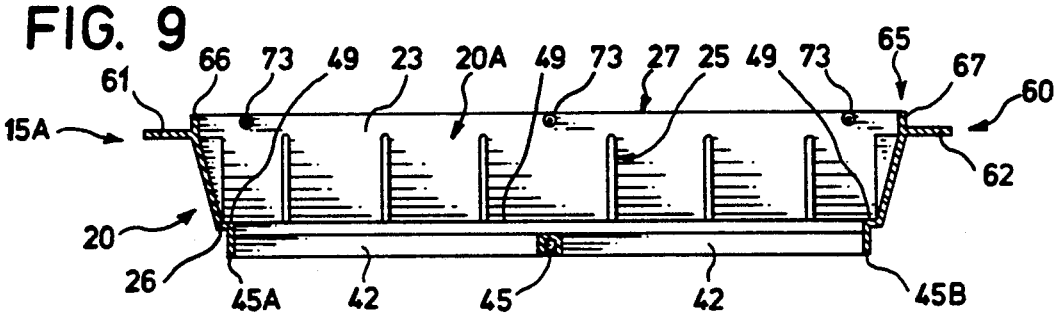
FIG. 9 is a sectional view taken generally along line 9—9 of FIG. 3.
Figure 10:
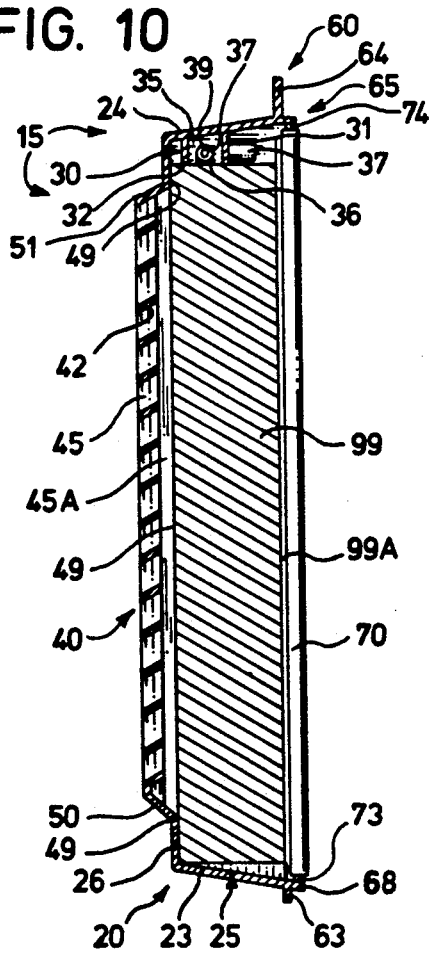
FIG. 10 is a vertical sectional view of the assembled system taken generally along line 7—7 of FIG. 3.
Figure 11:
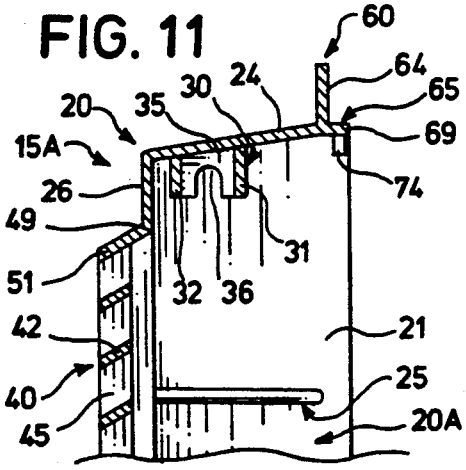
FIG. 11 is an enlarged fragmentary sectional view the top portion of FIG. 7; and, FIG. 12 is an enlarged fragmentary sectional view of the bottom portion of FIG. 7.
Figure 12:
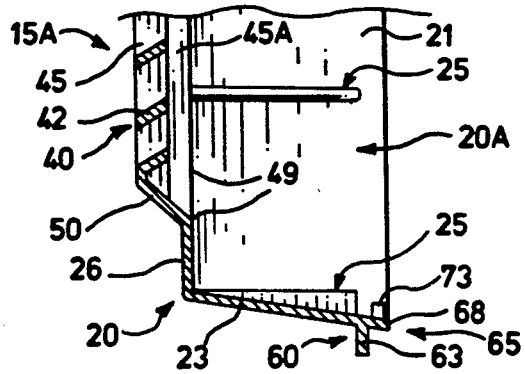

The body 20 is primarily comprised of two sides 21 and 22, extending between a bottom 23, and a top 24 defining a face 26 and an open back 27. The bottom 23 slopes downward away from the louvers 40 while the sides 21 and 22 and top 24 are disposed at an angle similar to the bottom 23. Hence, the body 20 generally forms a slice of a truncated pyramid (FIGS. 4 and 5). Turing to the interior of the body, as illustrated in FIGS. 6 and 10 the sides 21 and 22 and bottom 23 employ wedge or triangular shaped ribs 25 to square the body taper. The ribs also define a generally rectangular the interior volume 20A for confining the evaporative media 99. In other words, the ribs 25 are intended to support relatively rigid evaporative media such as CEL-Dek TM manufactured by Munters Inc. The bases 25A of the ribs 25 also define a plane across the open back 27, parallel with the face 26. A trough 30 is disposed along the interior of the top 24. This trough 30 is formed by two vertical spaced apart walls 31 and 32. Snap fittings 33 and 34 span the ends of the trough. Snap fit 35 spans the approximate center of the trough 30. The snap fits 33-35 define concentric U-shaped notches 36. The U-shaped notches 36 captivate a water distribution tube 37.

The water distribution tube 37 is an L-shaped length of plastic tubing secured to a water supply at one end and having a cap 38 disposed upon the other end. A plurality of orifices 39 are disposed within the tube's dorsal surface. In operation the water distribution tube 37 is supplied with a water flow sufficient to fill it and provide the necessary moisture to the evaporative media 99. Once the tube 37 is full, water will weep from the orifices 39. This water then drips to the evaporative media 99, wetting the media 99 and/or maintaining its moisture content. This configuration permits the tube 37 to supply water to the evaporative media without the orifices 39 becoming clogged with sediment as they would if they were disposed in the ventral surface of the tube 37. Further, the water is better dispersed as it flows over the surface of the tube than it would be if it were released directly onto the media 99.

Figure 7:
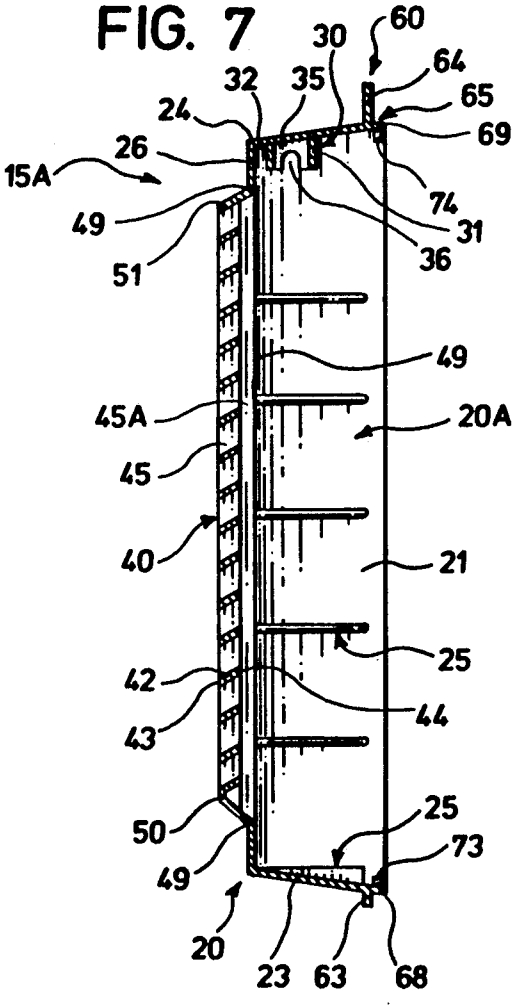
FIG. 7 is a sectional view of the panel taken generally along line 7—7 of FIG. 3, with portions thereof omitted for clarity.

The louver assembly 40 is composed of two sets of parallel, downwardly sloping individual louvers 42 extending between a side louver rail 45A or 45B and a central louver rail 45. The louver assembly 40 extends generally perpendicular to the body 20. The individual louvers 42 slant downward from the interior of the body to the exterior. In other words, the individual louvers 42 are disposed with their outside face 43 lower than their inside face 44 (FIG. 7). This sloping facilitates retention of moisture within the system 15 by preventing evaporation of the moisture provided to the media 99. Concurrently, the slope deters rain from entering the unit 16 and overwetting the media 99 or damaging the unit when not in use. Furthermore, the louver assembly 40 is offset from the evaporative media 99 to facilitate further retention of moisture and isolation from the natural elements. A shoulder 49 formed by the interior of the face 26 between the louver assembly 40 and the sides 21, 22 top 24 and bottom 23 provides the off-set for the media 99 relative to the louver assembly 40. As evidenced above, the central louver rail 45 allows the louvers to be of a shorter overall length. Therefore, they are stiffer than if they traversed the entire width of the face 26. The lower and upper bulwarks 50 and 51 of the louver assembly 40 slope away from the individual louvers 42. The lower bulwark 50 allows water that is deflected by the slope of the louvers 42 to be directed to the downward sloping body bottom 23 and thereby to the interior of the unit 16.

A peripheral mounting flange 60 extends outward from the sides 21 and 22, the bottom 23 and the top 24 generally coincident with the plane formed by the base of the ribs 25A. The flange sections 61, 62 and 64 extending from the sides 21 and 22 and the top 24 respectively, are wider than the flange 63 traversing the bottom 23. The flange 60 is constructed of the same resilient plastic material as the rest of the panel 15A. Therefore, the flange 60 is adaptable to a variety of cabinet 16 configurations. The flange 60 can be cut to fit particular channelways 17 already disposed on cooler cabinets 16. Additionally, if mounting the system in existing channelways 17 is not possible the flange 60 can be drilled and screwed directly onto to the existing cabinet 16.

A peripheral lip 65 extends from the flange 60. The lip sections 66, 67 an 69 extending from the side and top flange sections 61, 62 and 64, respectively, are generally perpendicular to the flange 60. However, the bottom lip section 68 extending from the bottom flange section 63 is disposed at an angle similar to the angle of repose of the body bottom 23. The angle of the bottom lip 68 further accommodates the drainage of water from the system 15. The peripheral lip 65 terminates in an edge 65A.

Resilient retaining bars 70 constructed of round PVC tubing extend vertically from the bottom lip portions 68 to the top lip portions 69. These bars 70 are snap fitted onto paired circular bosses 73 and 74 disposed on the top and bottom peripheral lip portions 68 and 69. The bosses 73 and 74 are cast into the lip 65 between the terminal edge 65A and the plane formed by the base of the ribs 25A. The retaining bars 70 secure the evaporative media 99 within the interior volume 20A of body 20. Polyester filter pad 99A is held flushly against the plane formed by the rib bases 25A by the retaining bars 70.

To replace the evaporative media 99 and the polyester pad 99A after the system 15 has been removed from the cooler cabinet 16, one simply removes the retaining bars 70 by bending them. The present system facilitates the use of two smaller pieces of evaporative media 99 to fill the interior volume 20A rather than the use of one larger piece. The advantages of using two pieces include reduced media cost and ease of installation. Once the new evaporative media is placed in the interior volume 20A, the retaining bars can be reinstalled by slipping one end over one of the bosses 73 or 74 and flexing the retaining bar 70. Then the second end of the bar 70 is mated to the opposite boss 74 or 73, and the bar 70 released. Then the system may be remounted on the cooler cabinet 16.

Figure 2:
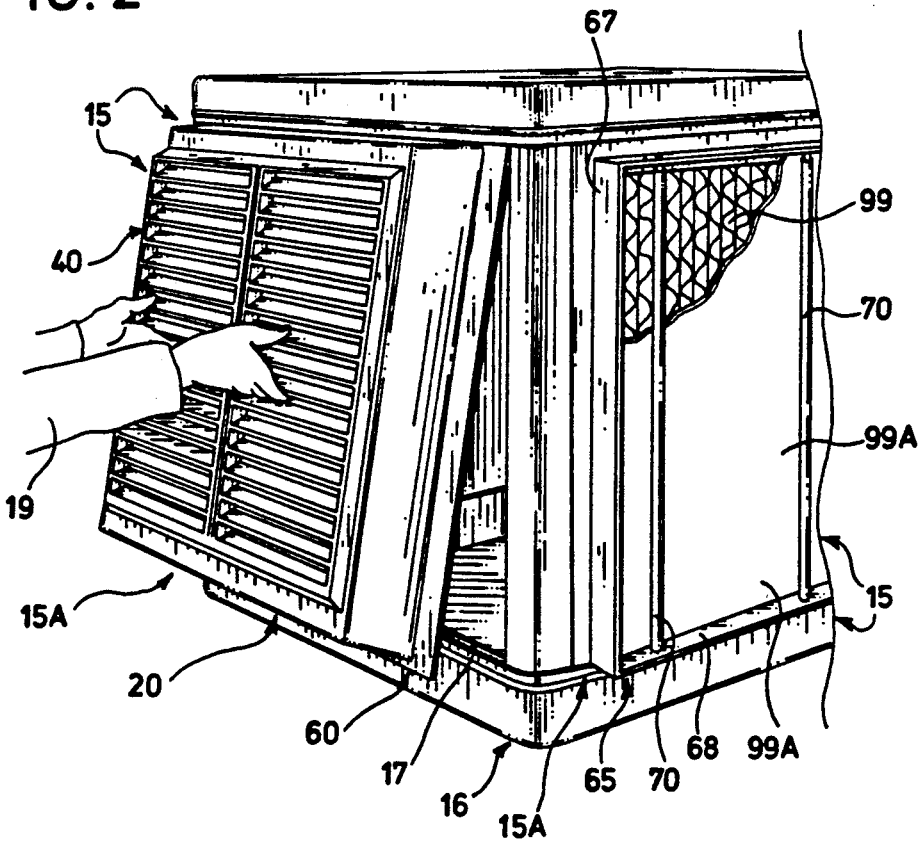
FIG. 2 is a fragmentary perspective view showing how one of my systems may typically be installed or removed, and how systems may be oriented for shipping with OEM coolers.

The reversible aspect of the present system is illustrated in FIG. 2. An individual 19 is shown installing or removing a system 15 disposed on one side of a cooler cabinet 16. On the other visible side of the unit 16 is a system 15 disposed in the original equipment manufacture's shipping configuration. The media 99, polyester filter pad 99A and retaining bars 70 are in place within the panel 15A; but, the system 15 is mounted in a reversed position, relative to how it will be mounted for use. Therefore, the voluminous body 20, louver assembly 40 and media 99 are disposed within the unit 16. This configuration allows a shipper or manufacturer to reduce the volume a unit 16 occupies during shipping or storage.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A modular louver system adapted to be retrofitted to evaporative air coolers, said system comprising:

a resilient, molded panel adapted to be fitted to the air cooler, said panel comprising:

a gently tapered body generally in the form of a slice of a truncated pyramid, said body comprising a top, a bottom, and two spaced apart sides integrally extending between said top and said bottom all bounding an interior volume, said body comprising a front face and an open back bounded by said top, bottom and sides;

said front face comprising an inner shoulder bounding said interior volume, and said top, bottom, and sides comprising inner surface portions bounding said interior volume;

a plurality of louver rails defined in said front face that project outwardly therefrom;

a plurality of inclined, spaced apart and generally parallel louvers integrally extending between said louver rails for admitting air into said interior volume, each of said louvers comprising an inner surface facing within said interior volume;

a peripheral flange integral with said body for securing said panel to said cooler, said flange dividing said body into a peripheral lip adapted to be received by said cooler, said lip comprising a terminal edge;

evaporative media generally in the form of a parallelepiped adapted to be received within said internal volume and spaced apart from said louvers;

a water distribution tube secured to said body top and disposed over said evaporative media;

a filter disposed between said evaporative media and said lip terminal edge; and, a plurality of spaced apart retaining bars removably snap fitted to said panel at said open back.

2. The louver system as defined in claim 1 further comprising a plurality of spaced apart generally wedge-shaped ribs defined on said inner surface portions of said body sides and said body bottom for squaring the body taper to snugly mate with said evaporative media and retain it in said volume.

3. The louver panel as defined in claim 2 including a trough disposed on said inner surface of said top for receiving said water distribution tube.

4. The louver system as defined in claim 3 wherein said trough comprises a plurality of spaced apart, grooved snap fits for yieldably retaining said water distribution tube above said evaporative media.

5. The louver panel as defined in claim 1 wherein said front face shoulder is offset from said inner surface of said louvers to isolate said evaporative media from said louvers.

6. The louver system as defined in claim 1 further comprising a plurality of spaced apart bosses integrally formed in said body and projecting from said inner surfaces of said top and bottom for removably receiving said retaining bars.

7. The louver system as defined in claim 1 wherein said wedge shaped ribs comprise upright base portions forming a common plane that is offset from said lip terminal edge and is adapted to be contacted by a said filter.

8. The louver system as defined in claim 13 wherein said bosses are disposed between said lip terminal edge and said common plane formed by the base of said wedge-shaped ribs.

9. The louver system as defined in claim 1 wherein the top portion and the side portions of said lip are generally perpendicular to said flange, but a bottom portion of said lip is angularly downwardly flared with respect to said flange to drain water.

10. An evaporative air cooler comprising at least one modular louver system comprising:

a cabinet adapted to be disposed upon a supporting surface, said cabinet having an interior;

at least one resilient, molded panel adapted to be fitted to said cabinet, said panel comprising:

a tapered body comprising a top, a bottom, and two spaced apart sides integrally extending between said top and said bottom all bounding an interior volume, said body comprising a front face and an open back bounded by said top, bottom and sides;

said front face comprising an inner shoulder bounding said interior volume, and said top, bottom, and sides comprising inner surface portions bounding said interior volume;

a plurality of louver rails defined in said front face that project outwardly therefrom;

a plurality of inclined, spaced apart and generally parallel louvers integrally extending between said louver rails for admitting air into said interior volume, each of said louvers comprising an inner surface facing within said interior volume;

said shoulder being offset from said inner surface of said louvers to isolate said evaporative media from said louvers.

a peripheral flange integral with said body for securing said panel to said cooler, said flange dividing said body into a peripheral lip adapted to be received by said cooler, said lip comprising a terminal edge;

evaporative media generally in the form of a parallelepiped adapted to be received within said internal volume and spaced apart from said louvers;

a water distribution tube secured to said body top and disposed over said evaporative media;

a trough disposed on said inner surface of said top for receiving said water distribution tube;

a filter disposed between said evaporative media and said lip terminal edge; and, a plurality of spaced apart retaining bars removably snap fitted to said panel at said open back.

11. The louver system as defined in claim 10 wherein said panel comprises:

a plurality of spaced apart generally wedge-shaped ribs defined on said inner surface portions of said body sides and said body bottom for squaring the body taper to snugly mate with said evaporative media and retain it in said volume; and, a plurality of spaced apart bosses integrally formed in said body and projecting from said inner surfaces of said top and bottom for removably receiving said retaining bars;

12. The louver system as defined in claim 11 wherein said wedge shaped ribs comprise upright base portions forming a common plane that is offset from said lip terminal edge and is adapted to be contacted by a said filter.

13. The louver system as defined in claim 12 wherein said bosses are disposed between said lip terminal edge and said common plane formed by the base of said wedge-shaped ribs.

14. The louver system as defined in claim 13 wherein said trough comprises a plurality of spaced apart, grooved snap fits for yieldably retaining said water distribution tube above said evaporative media.

* * * * *